US005656061A

United States Patent [19]

Miller et al.

[11] Patent Number: 5,656,061

[45] Date of Patent: Aug. 12, 1997

[54] METHODS OF CLOSE-COUPLED ATOMIZATION OF METALS UTILIZING NON-AXISYMMETRIC FLUID FLOW

[75] Inventors: Steven Alfred Miller, Amsterdam; Russell Scott Miller, Ballston Spa, both of N.Y.

[73] Assignee: General Electric Company, Schenectady, N.Y.

[21] Appl. No.: 442,427

[22] Filed: May 16, 1995

[51] Int. Cl.[6] ..... B22F 9/08

[52] U.S. Cl. ..... 75/337; 75/338

[58] Field of Search ..... 75/337, 338, 339; 264/12

[56] References Cited

U.S. PATENT DOCUMENTS

| | | | |
|---|---|---|---|
| 3,663,206 | 5/1972 | Lubanska | 75/338 |
| 4,401,609 | 8/1983 | McGarry et al. | 264/12 |
| 4,485,834 | 12/1984 | Grant | 264/12 |
| 4,619,597 | 10/1986 | Miller | 264/12 |
| 4,626,278 | 12/1986 | Kenney et al. | 266/202 |
| 4,631,013 | 12/1986 | Miller | 264/12 |
| 4,779,802 | 10/1988 | Coombs | 264/12 |
| 4,801,412 | 1/1989 | Miller | 264/12 |
| 4,905,899 | 3/1990 | Coombs et al. | 264/12 |
| 4,946,082 | 8/1990 | Brun et al. | 222/606 |
| 4,966,201 | 10/1990 | Svec et al. | 138/141 |
| 4,978,039 | 12/1990 | Brun et al. | 222/606 |
| 4,993,607 | 2/1991 | Brun et al. | 222/606 |
| 5,004,629 | 4/1991 | Svec et al. | 427/204 |
| 5,011,049 | 4/1991 | Borom et al. | 222/590 |
| 5,022,150 | 6/1991 | Brun et al. | 29/890.053 |
| 5,048,732 | 9/1991 | Borom et al. | 222/606 |
| 5,244,369 | 9/1993 | Miller et al. | 264/12 |
| 5,289,975 | 3/1994 | Miller et al. | 239/79 |
| 5,310,165 | 5/1994 | Benz et al. | 266/202 |
| 5,325,727 | 7/1994 | Miller et al. | 73/861.61 |
| 5,346,530 | 9/1994 | Miller et al. | 75/331 |
| 5,366,204 | 11/1994 | Gigliotti et al. | 266/202 |

FOREIGN PATENT DOCUMENTS

| | | | |
|---|---|---|---|
| 4-66609 | 3/1992 | Japan | 75/337 |
| 1163996 | 6/1985 | U.S.S.R. | 264/12 |

OTHER PUBLICATIONS

"Atomization of Melts for Powder Production and spray Deposition," Andrew J. Yule and John J. Dunkley, Oxford Series on Advanced Manufacturing, 1994, pp. 172–179.

*Primary Examiner*—George Wyszomierski
*Attorney, Agent, or Firm*—William H. Pittman

[57] ABSTRACT

Close-coupled atomization methods employing non-axisymmetric fluid flow geometries have demonstrated superior efficiency in the production of fine superalloy powder, such as, for example, nickel base superalloys compared to conventional close-coupled atomization utilizing an axisymmetric gas orifice and an axisymmetric melt nozzle. It is believed that the principal physical mechanisms leading to non-axisymmetric atomization system fine powder yield improvement are atomization plume spreading, the at least lessening of the melt pinch down at the interaction point between the atomization liquid and the liquid melt and improved melt film formation at the melt guide tube tip. The greatest fine powder yield improvement occurred when the non-axisymmetric atomization systems are operated with atomization parameters that result in the formation of multiple atomization plumes. Recognition of the atomization plume characteristics ranging from pinch-down to spreading to multiple sub-plume formation provides a basis for atomization process control to provide the greatest fine powder yield improvement verses conventional close-coupled axisymmetric atomization systems.

21 Claims, 9 Drawing Sheets

METHODS OF CLOSE-COUPLED ATOMIZATION OF METALS UTILIZING NON-AXISYMMETRIC FLUID FLOW

RELATED APPLICATIONS

This application is related to commonly assigned, U.S. patent application, Ser. No. 08/338,995 filed Nov. 14, 1994, of Miller et al.; U.S. patent application Ser. No. 08/415,914 of Miller et al., filed Apr. 3, 1995; and U.S. patent application Ser. No. 08/414,834 of Miller, et al., filed Apr. 3, 1995, now U.S. Pat. No. 5,532,981; U.S. patent application Ser. No. (RD-24,045) of Miller et al., filed concurrently herewith, the disclosure of each is hereby incorporated by reference.

BACKGROUND OF THE INVENTION

The present invention relates generally to closely coupled gas atomization of metals. More particularly, it relates to methods of operation of close-coupled atomization systems and for preparing metal powders which result in increased yields of fine particles. Most particularly, it relates to methods for positioning the melt stream flow away from the atomization plume center toward the atomization plume periphery resulting in the efficient atomization of metals, specifically superalloys.

The development of atomization systems having fluid, such as gas, atomization nozzles for the production of metallic powders started with remote gas jets, or metal freefall designs, and more recently evolved to close-coupled designs in the quest for greater efficiency and increased yields of fine powder. Many of the early remote jet designs employed a small number of individual gas jets. As the designs matured, the number of jets increased until the limiting case of an annular jet was employed. Almost universally, (see U.S. Pat. No. 4,401,609), the technology moved toward the application of axisymmetric melt and axisymmetric gas flows for fine powder efficiency improvements. The knowledge base regarding axisymmetric melt and axisymmetric gas flows generated with remote gas jets was carried over into the design of early close-coupled nozzle atomization systems. During early efforts to increase fine powder yields, gas plenum designs received considerable attention in order to ensure a high degree of gas flow symmetry. For a detailed discussion of the history of the atomization of melts, both axisymmetric and asymmetric (non-axisymmetric), see "Atomization of Melts for Powder Production and Spray Deposition," A. J. Yule and J. J. Dunkley, Oxford University Press, 1994, the disclosure of which is hereby incorporated by reference.

Conventional close-coupled atomization gas nozzles and melt guide tubes typically include axisymmetric melt guide tubes with either annular gas nozzle orifices or multiple discrete gas jets. Although multiple jet designs represented a deviation from purely axisymmetric atomization, there is significant evidence that the individual gas jet streams merged together providing a substantially axisymmetric gas flow prior to contacting the liquid melt stream.

While close-coupled or closely coupled metal atomization is a relatively new technology, methods and apparatus for the prior practice of close-coupled atomization are set forth in commonly owned U.S. Pat. Nos. 4,619,597; 4,631,013; 4,801,412; 4,946,082; 4,966,201; 4,978,039; 4,993,607; 5,004,629; 5,011,049; 5,022,150; 5,048,732; 5,244,369; 5,289,975; 5,310,165; 5,325,727; 5,346,530 and 5,366,204, the disclosures of each are incorporated herein by reference. Among other things, these patents disclose the concept of close coupling, i.e., to create a close spatial relationship between the point at which a melt stream emerges from a melt guide tube orifice and a point at which a gas stream emerges from a gas nozzle orifice to impact or intersect the melt stream and interact therewith to produce an atomization zone.

Because known prior attempts to operate closely coupled atomization apparatus resulted in many failures due to the many problems which were encountered, most of the prior art, other than those mentioned above, for atomization technology concerned remotely coupled apparatus and practices, the technology disclosed by the above referenced patents is believed to be one of the first, if not the first, successful closely coupled atomization systems to be developed that had potential for commercial operation.

For a metal atomization processing system, accordingly, the higher the percentage of the finer particles which are produced the more desirable the properties of the articles formed from such fine powder by conventional powder metallurgical techniques. For these reasons, there is a strong economic incentive to produce higher and higher yields of finer particles through atomization processing.

As pointed out in the commonly owned patents above, the close-coupled atomization technique results in the production of powders from metals with a higher concentration of fine powder. For example, it was pointed out therein that by the remotely coupled technology only about 3% of powder produced industrially is smaller than 10 microns and the cost of such powder is accordingly very high. Fine powders of less than 37 microns in diameter of certain metals are used, for example, in low pressure plasma spray applications. In preparing such fine powders by remotely coupled techniques, as much as about 60% to about 75% of the resulting powder must be scrapped because it is oversized. The need to selectively separate out and keep only the finer powder and to scrap the oversized powder increases the cost of producing usable fine powder.

Further, the production of fine powder is influenced by the surface tension of the melt from which the fine powder is produced. High surface tension melts increase the difficulty in producing the fine powder and, thus, consume more gas and energy. The remotely coupled industrial processes for atomizing powder of less than 37 microns average diameter from molten metals having high surface tensions have yields on the order of about 25 weight % to about 40 weight %.

A major cost component of fine powder prepared by atomization and useful in industrial applications is the cost of the gas used in the atomization. The gas consumed in producing powder, particularly the inert gas such as, for example, argon, is expensive. Thus, it is economically desirable to be able to produce a higher percentage of fine powder particles using the same amount of gas.

As is explained more fully in the commonly owned patents referred to above, the use of the close-coupled atomization technology resulted in the formation of higher concentrations of finer particles than was available through the use of prior remotely coupled atomization techniques.

With rare exception, for both close-coupled and remote atomization systems, designers have attempted to maintain an axisymmetric relationship between the melt flow and the gas flow. Most often, this was accomplished by using a circular melt stream surrounded by an annular, circular gas jet or a circular array of individual gas jets. Some linear atomizers have been reported using a long thin rectangular slit for the melt orifice (see U.S. Pat. No. 4,401,609). But even here the gas jet geometry is designed to provide a uniform melt spray pattern along the long axis of the slit. Only one remote atomizing nozzle and one, non-axisymmetric close-coupled atomizing nozzle are known to have existed prior to the non-axisymmetric system disclosed herein (see U.S. Pat. Nos. 4,631,013 and 4,485,834). Few, if any, non-axisymmetric melt guide tube exit orifices or non-axisymmetric gas orifice configurations are believed to have been proposed in order to achieve higher yields of fine particles.

While the early close-coupled atomization systems and methods increased the yields of fine powder relative to the metal free fall remotely coupled system, there is a continuing industrial demand for additional increased yields of ultra fine metal powders, e.g., powders having a particle diameter smaller than 37 microns. Accordingly, there is a need to develop metal atomization methods which can increase the yield of such ultra fine powder and narrow the distribution of particle sizes formed and do so with increased efficiency and lower cost. Any resulting methods should produce improved fine powder yields while being compatible with at least one and preferably both low and high melt superheat metal processing systems.

SUMMARY OF THE INVENTION

In carrying out the present invention in preferred forms thereof, we provide improved methods for metal atomization which include the utilization of non-axisymmetric fluid flow such that the melt core is positioned away from the center of the atomization plume toward the periphery of the atomization plume for making powders having a particle diameter smaller than 37 microns. Illustrated methods utilizing the resulting atomization systems which include the utilization of non-axisymmetric fluid flow for positioning the melt core away from the center of the atomization plume toward the periphery thereof for making powders having a particle diameter smaller than, for example, 37 microns are disclosed herein.

A specific example of the present invention wherein the bulk of liquid metal in the atomization plume is located at least partially away from the center of the atomization plume toward the periphery of the atomization plume includes a method of atomizing molten metal in a close-coupled atomization system, the close-coupled atomization system including a plenum means having a channel therein for delivering atomizing fluid, a melt guide tube extending axially through the plenum to an exit orifice, for delivering molten metal to an atomization zone and means for supporting the melt guide tube in the plenum means, the method comprising the steps of: providing molten metal to the melt guide tube such that molten metal exits the melt guide tube exit orifice; and providing non-axisymmetric atomizing fluid to the plenum means such that at least some atomizing fluid is forced out the channel and into contact with the molten metal at a molten metal/gas interaction point to produce an atomization plume having an axis, the plume containing, within at least about five (5) melt guide tube tip diameters down stream from the molten metal/gas interaction point, at least two separate sub-plumes.

Another specific example of the present invention includes a method of atomizing molten metal in a close-coupled atomization system, the close-coupled atomization system including a plenum means having a channel therein for delivering atomizing fluid, a melt guide tube extending axially through the plenum to an exit orifice, for delivering molten metal to an atomization zone and means for supporting the melt guide tube in the plenum means, the method comprising the steps of: providing molten metal to the melt guide tube such that molten metal exits the melt guide tube exit orifice; and providing non-axisymmetric atomizing fluid to the plenum means such that at least some atomizing fluid is forced out the channel and into contact with the molten metal at a molten metal/gas interaction point to produce an atomization plume having an axis, the plume containing, within at least about five (5) melt guide tube tip diameters down stream from the molten metal/gas interaction point, at least three separate sub-plumes.

Accordingly, an object of the present invention is to provide atomization methods for providing increased yields of metal powder having a particular diameter of at least 37 microns.

A further object of the present invention is to provide atomization methods which provide improved yields of fine powders and is compatible with both low and high melt superheat metal processing systems.

A still further object of the present invention is to provide atomization methods which includes providing non-axisymmetric fluid flow to form an atomization plume containing, within at least about five (5) melt guide tube tip diameters down stream from the molten metal/gas interaction point, such that at least two separate sub-plumes are formed within the atomization plume.

Other objects and advantages of the invention will be apparent from the following description, the accompanying drawings and the appended claims.

DESCRIPTION OF THE PREFERRED EMBODIMENTS AND METHODS

As part of a continuing atomization system development effort to achieve high yields for fine powder, which had emphasized axisymmetric annular gap type fluid nozzle and melt guide tube geometries, non-axisymmetric geometries and their effects have now been studied. Non-axisymmetric configuration/geometry effects range from subtle gas distribution changes in the gas plenum to extreme non-axisymmetry in the melt delivery nozzle. These studies were motivated by an attempt to understand yield variability in axisymmetric close-coupled atomization systems and a parallel search for close-coupled atomization system configurations, both close-coupled atomization nozzles and melt guide tube exit orifices, compatible with both low and high melt superheat processing which would result in improved yields of fine powder.

The studies conducted indicated that non-axisymmetric gas flow and/or non-axisymmetric melt flow in close-coupled atomization systems can be superior to axisymmetric gas flow and axisymmetric melt flow for the production of fine powder. It is now recognized that a commonalty in physical mechanisms apply to both types of non-axisymmetric flow.

Figure 1:
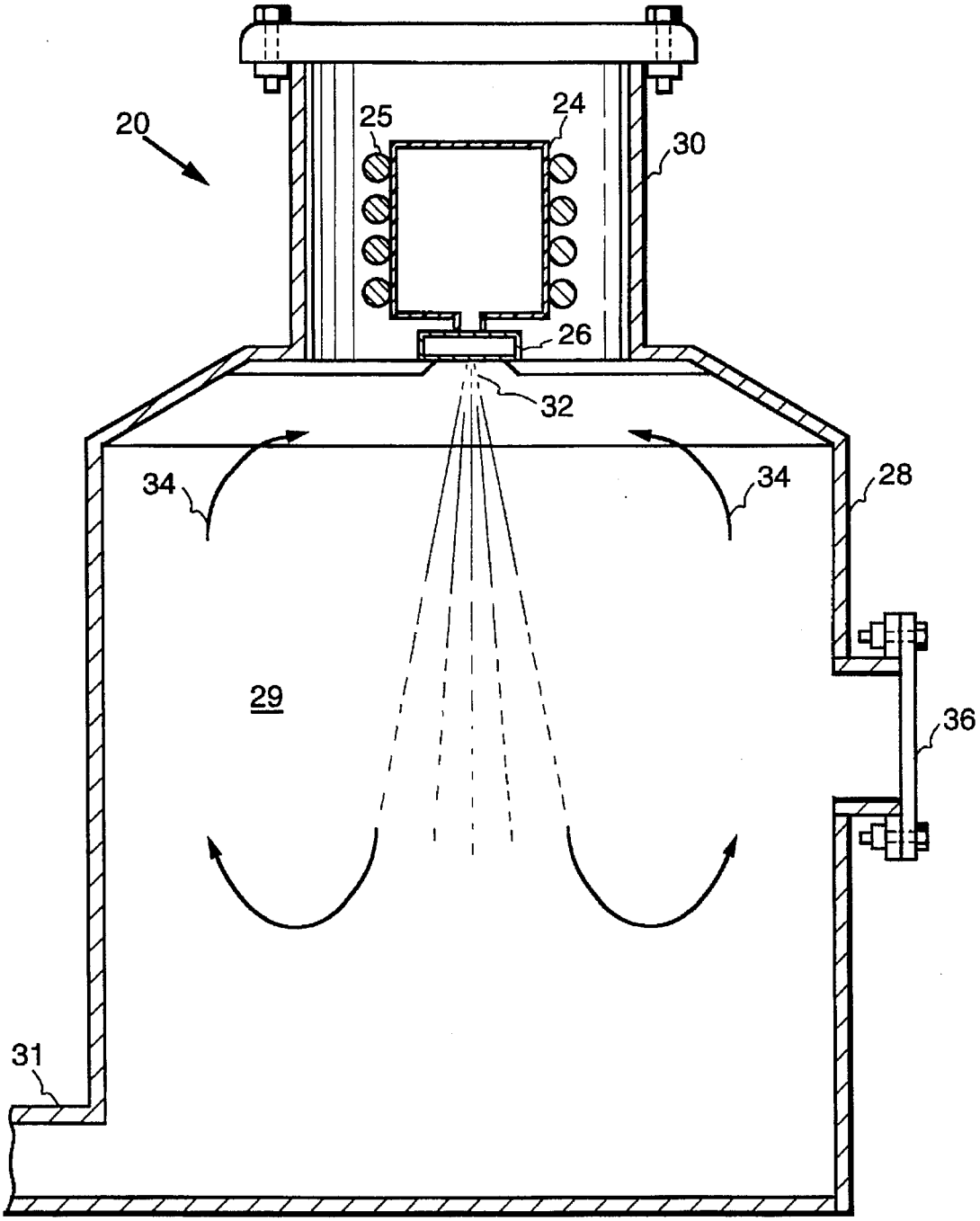
FIG. 1 is a schematic side view of a representative atomization system for atomizing molten metal.

First, prior to discussing the details of the present invention, two representative prior atomization systems will be described. A representative high melt superheat close-coupled atomization system is illustrated as generally designated by the numeral 20 in FIG. 1. As can be seen, the system 20 comprises a crucible 24, a nozzle 26, and an enclosure 28. The crucible 24 is formed of suitable material for holding the liquid metal, e.g. ceramic such as alumina or zirconia, or water cooled copper. A conventional heating means such as element 25 can be positioned for heating the molten metal therein. The molten metal in crucible 24 can be heated by any suitable means, such as an induction coil, plasma arc melting torch, or a resistance heating coil. The crucible 24 has a bottom pouring orifice coupled with a melt guide tube in nozzle 26. The crucible 24, and nozzle 26 are conventionally mounted on atomization enclosure 28.

The atomization enclosure 28, formed from a suitable material, such as, for example, steel is configured to provide an inner chamber 29 suitable for containing the atomization process. Depending upon the metal being atomized, enclosure 28 can contain an inert atmosphere or vacuum. A suitable crucible enclosure 30 can be formed over the crucible 24 to contain an inert atmosphere for the liquid metal. A conventional vacuum pump system, not shown, or gas supply means, not shown, are coupled with atomization enclosure 28 and crucible enclosure 30 to provide the inert atmosphere or vacuum therein. A conventional exhaust system, not shown, for example with cyclone separators, is coupled with enclosure 28 at connection 31 to remove the atomized powder during the atomization process.

A stream of liquid metal from crucible 24 is atomized by the nozzle 26, forming a plume (such as an axisymmetric plume, the cross section of which is a circle) of molten metal droplets 32 which are rapidly quenched to form solid particulates of the metal. Prior Art close-coupled nozzles are shown, for example, in U.S. Pat. Nos. 4,801,412, 4,780,130, 4,778,516, 4,631,013, and 4,619,845. The nozzle 26 directs a stream of liquid metal into a converging supersonic jet Of atomizing gas. The high kinetic energy of the supersonic atomizing gas breaks up the stream of liquid metal into atomized droplets which are widely dispersed in the atomization enclosure. As a result, within several seconds of the initiation of atomization, the atomization vessel is filled with a cloud of recirculating powder particulates, for example shown by arrows 34. While atomization of the liquid metal stream can be viewed at the initiation of atomization, for example from view port 36 mounted on atomization enclosure 28, the interaction between the atomizing gas jet and the liquid metal stream is obscured by the cloud of metal particulates within a few seconds.

Figure 2:
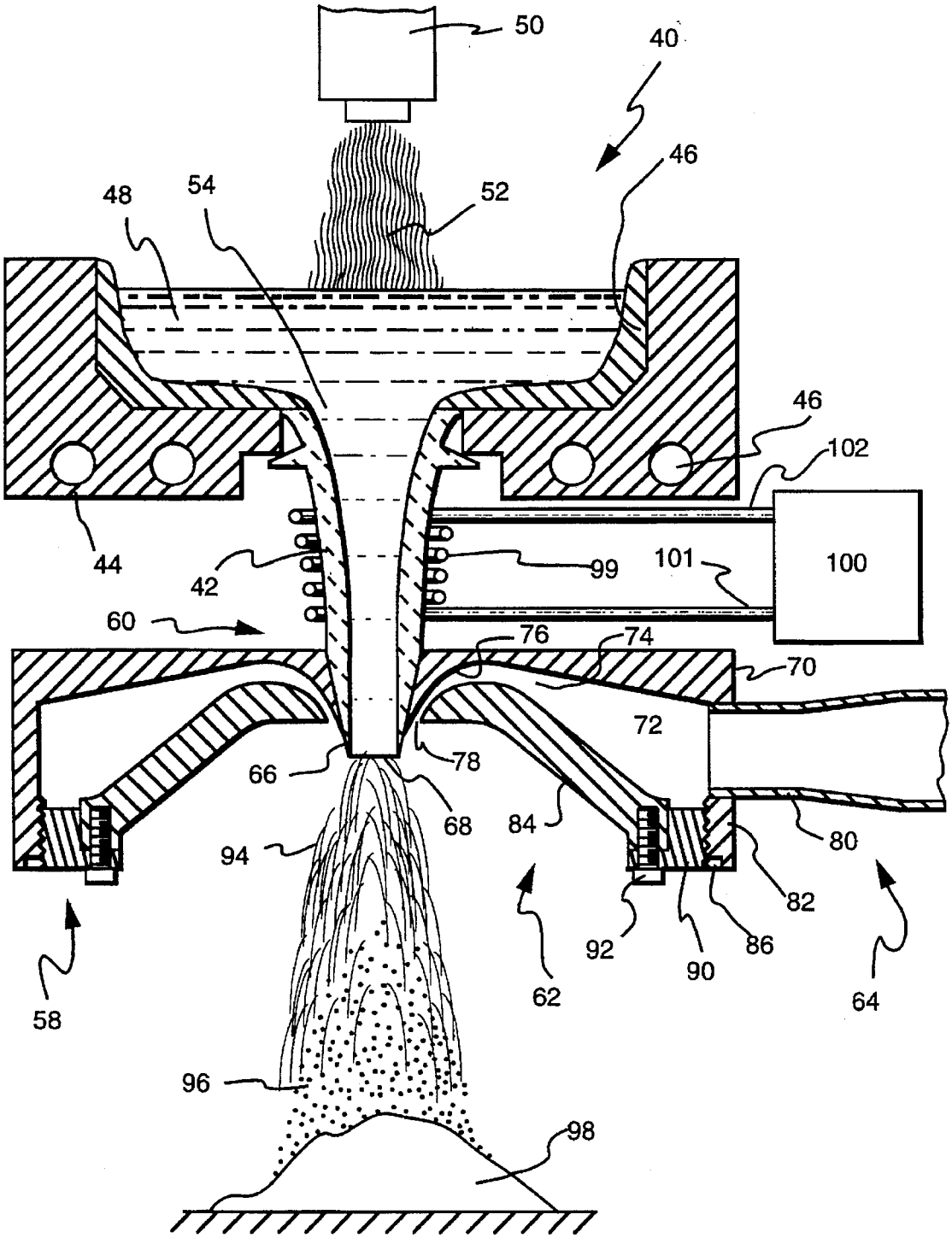
FIG. 2 is a sectional view of a cold hearth apparatus operatively linked to an induction heated melt guide tube and to shallow close-coupled nozzle atomization apparatus.

FIG. 2 illustrates a representative close-coupled atomization system compatible with low melt superheat metal processing. The system, as illustrated, is described in commonly assigned U.S. Pat. No. 5,366,204 issued Nov. 22, 1994.

As described therein, a melt supply reservoir and a melt guide tube are shown semischematically. The melt is supplied from a cold hearth apparatus 40 which is illustrated undersize relative to a melt guide tube 42. The cold hearth apparatus includes a copper hearth or container 44 having water cooling passages 46 formed therein. The water cooling of the copper container 44 causes the formation of a skull 47 of frozen metal on the surface of the container 44, thus, protecting the copper container 44 from the action of the liquid metal 48 in contact with the skull 47. A heat source 50, which may be, for example, a plasma gun heat source, having a plasma flame 52 directed against the upper surface of the liquid metal of molten bath 48, is disposed above the surface of the cold hearth apparatus 40, The liquid metal 48 emerges from the cold hearth apparatus through a bottom opening 54 formed in the bottom portion of the copper container 44 of the cold hearth apparatus 40. Immediately beneath the opening 54 from the cold hearth, the melt guide tube 42 is disposed to receive melt descending from the reservoir of metal 48. The tube 42 is illustrated oversize relative to hearth 40 for clarity of illustration.

The melt guide tube 42 is positioned immediately beneath the copper container 44 and is maintained in contact therewith by mechanical means, not shown, to prevent spillage of molten metal emerging from the reservoir of molten metal 48 within the cold hearth apparatus 40. The melt guide tube 42 may be, for example, a ceramic structure or any structure which is resistant to attack by the molten metal 48. Melt guide tube 42 may be formed of, for example, boron nitride, aluminum oxide, zirconium oxide, or any other suitable ceramic material or other suitable material compatible with the metal atomization process. The molten metal flows down through the melt guide tube to the lower portion thereof from which it can emerge as a stream into an atomization zone.

Melt passes down through the melt guide tube and is atomized by a close-coupled atomization apparatus 58 which is more fully described in copending application Ser. Nos. 07/920,075, filed Jul. 27, 1992; and 07/920,066, filed Jul. 27, 1992, the disclosures of each are herein incorporated by reference.

As shown, there are three structural elements in the atomization structure of FIG. 2. The first is a central melt guide tube structure 60. The second is the gas atomization structure 62, and the third is the gas supply structure 64.

The melt supply structure 60 is essentially the lower portion of the melt guide tube structure 42. The melt guide tube is a structure which ends in an inwardly tapered lower end 66, terminating in a axisymmetric melt orifice 68. The axisymmetric gas atomization structure 62 includes a generally low profile housing 70 which houses a plenum 72 positioned laterally at a substantial distance from the melt guide tube 60. The atomizing gas from plenum 62 passes generally inwardly and upwardly through a narrowing neck passageway 74 into contact With a gas shield portion 76 where the gas is deflected inward and downward to the orifice 78 and from there into contact with melt emerging from the melt orifice 68.

The plenum 62 is supplied with gas from a gas supply, not shown, through the gas supply structure 64, such as a pipe. Pipe 64 has necked down portion 80 where it is attached to the wall 82 of the housing 70. The lower portion of plenum 62 is a shaped adjustable annular structure 84 having a threaded outer ring portion 86 by which threaded vertical movement is accomplished. Such movement is accomplished by turning the annular structure 84 to raise or lower it by means of the threads at the rim of ring 86 thereof. A ring structure 90 is mounted to annular structure 84 by conventional means such as bolt 92.

The gas atomized plume 94 of molten metal passes down to a region where the molten droplets solidify into particles 96 and the particles may accumulate in a pile 98 in a receiving container.

The present invention resulted from attempts to further increase fine powder yields by perfecting the axisymmetry of the gas flow from the gas nozzle to the melt in close-coupled atomization systems similar to those described above. In conjunction with this effort, fluid dynamic experts were consulted for improving the axisymmetric gas flow/melt flow in close-coupled atomization systems.

Specifically, when fluid dynamic experts were consulted concerning increasing the yields of fine powder for close-coupled atomization systems, such as those described above, they recommended significantly increasing the gas volume of the gas plenum. This recommendation was based upon the understanding that increasing the yields of fine powder was directly related to the degree of axisymmetric gas flow that was delivered from the gas plenum to the atomization zone. In other words, if it were true that the yields of fine powder were directly related to the degree of axisymmetric gas flow that was delivered to the atomization zone, then a plenum which delivered a pure (100%) axisymmetric gas flow to the atomization zone would produce the highest yields of fine powder.

Since, in their opinion, the relatively small volume plenum of the initial close-coupled nozzle designs had considerable room for improvement, with regard to more closely approaching pure axisymmetric gas flow, it was decided that the gas plenum volume should be increased to ensure that there were little, if any, pressure differences between different locations around the nozzle orifice. Circumferential pressure changes would cause circumferential changes in the momentum mass flux and the velocity of the gas as it exits the gas orifice, i.e. a condition of a non-axisymmetric gas flow. With axisymmetric gas flow, none of the above mentioned gas properties would change circumferentially around the gas orifice. It was thought that such a uniform situation (i.e., pure (100%) axisymmetric gas flow) would surely result in higher yields of fine powder and most likely the highest yields of fine powder possible. At this time, little attention was paid the melt stream configuration, which shape had also typically been an axisymmetric circle.

During the experiments that led to the recognition of the present invention, the measurement techniques and flow analysis methods derived from the study of axisymmetric close-coupled nozzles were applied to the study of closed coupled atomization systems having both non-axisymmetric fluid flow and non-axisymmetric melt flow. The measurement techniques included infrared imaging, high speed video, local pressure measurements, and water atomization.

It has now been found that the methods of the present invention which utilize non-axisymmetric gas flow provide an improved yield of fine particles during atomization as compared to the yields realized from the above described systems or the remotely coupled systems. For example, utilizing methods of the present invention, a nickel based superalloy powder having a particle size of about 37 microns or less can be formed with a yield of up to about seventy (70) percent to about eighty (80) percent as compared to yields of up to about forty (40) percent to about sixty (60) percent fine yields obtained from close-coupled fully axisymmetric methods. It has been observed that the core of liquid metal in the atomization plume has been broken into multiple cores and relocated away from approximately the center thereof toward the periphery thereof.

Figure 3B:
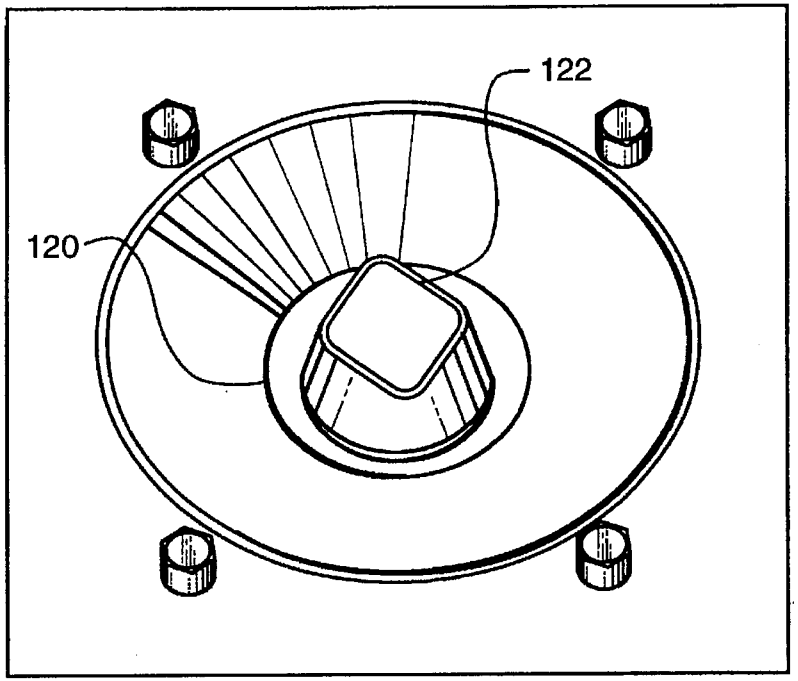
FIG. 3*b* is a partial perspective view of a non-axisymmetric gas flow nozzle including the non-axisymmetric exterior of the melt guide tube surfaces along with a non-axisymmetric square melt guide tube orifice.
Figure 3A:
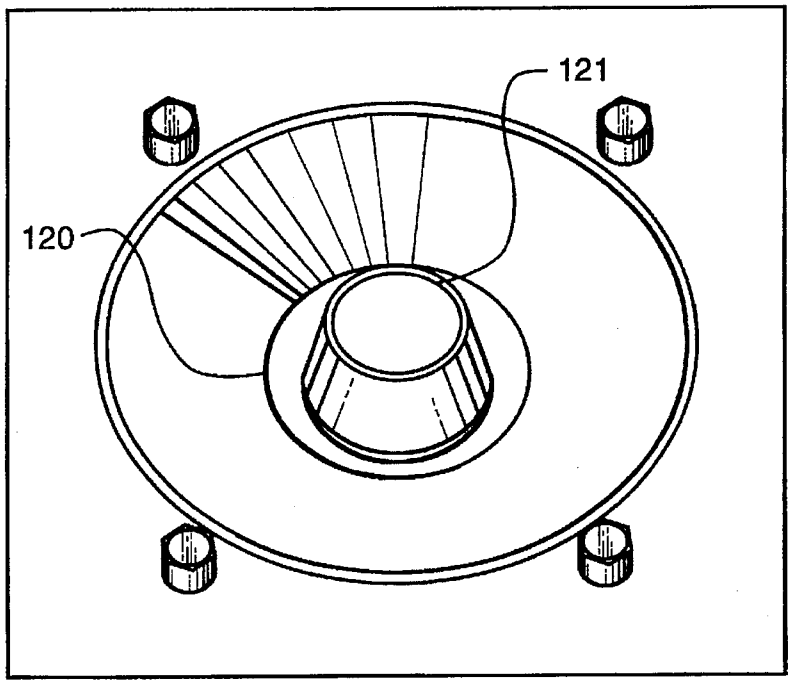
FIG. 3*a* is a partial perspective view of a prior art axisymmetric fluid nozzle and a prior art axisymmetric circular cross section melt guide exit tube.

A bottom view of both a typical axisymmetric and a high yield non-axisymmetric system, which may incorporate both non-axisymmetric fluid, such as, for example, gas or liquid flow geometries and non-axisymmetric melt guide tube exit orifice configuration or geometries is shown in FIGS. 3*a* and 3*b*, respectively. As illustrated in FIG. 3*a*, a circular gas orifice 120 surrounds a circular, axisymmetric cross section melt guide tube exit orifice 121. As illustrated in FIG. 3*b*, a complex shaped melt guide tube 122 transitions from an approximately circular cross section to an approximately square cross section at a point between the melt supply apparatus and the melt guide tube exit point.

Figure 3C:
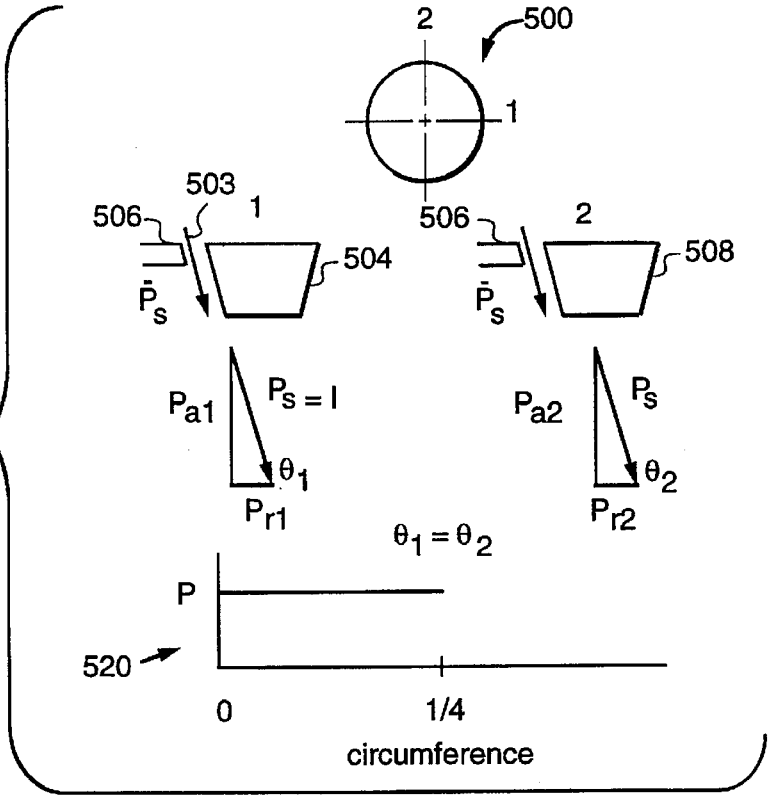
FIG. 3*c* is a schematic representation of the gas flow resulting from the fluid nozzle of FIG. 3*a;*
Figure 3D:
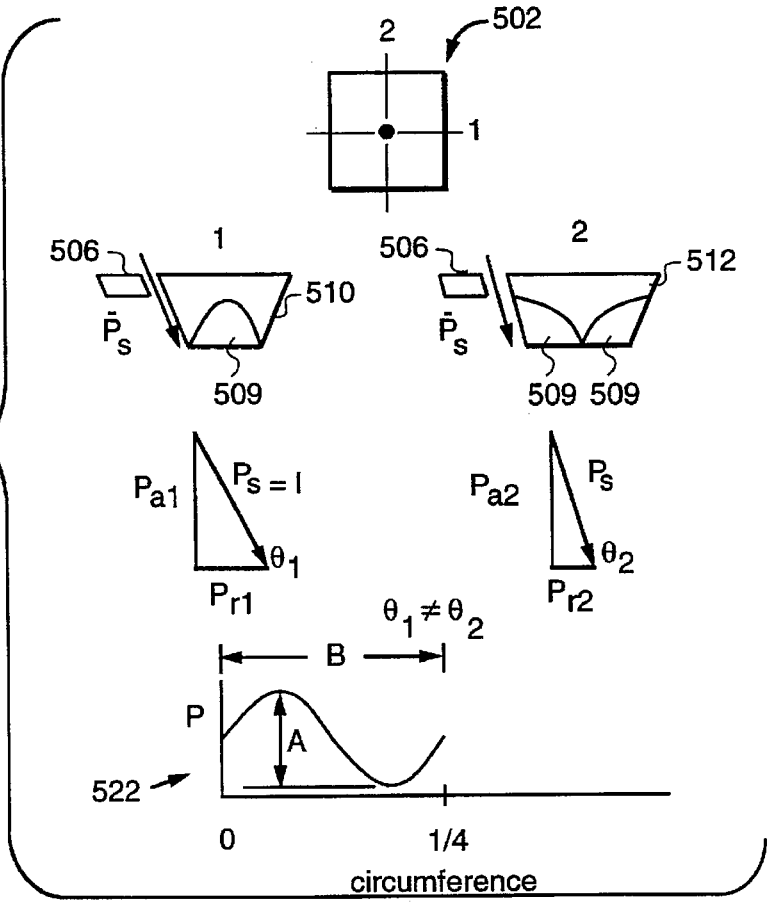
FIG. 3*d* is a schematic representation of the gas flow resulting from the fluid nozzle of FIG. 3*b;*

Once the importance of introducing non-axisymmetric flow was recognized, the means for accomplishing the non-axisymmetric gas flow was recognized as being virtually infinite. Specifically, any non-circular annulus or array of non-equal sized individual gas jets, non-right conical melt guide tube tips, use of non-concentric axisymmetric gas and melt flow, use of partitioned gas manifolds, etc. would create non-axisymmetric gas/melt flow. FIG. 3*d* is a representative illustration of one obvious possibility compared to axisymmetric flow, as illustrated in FIG. 3*c*. Although not all of the potentially infinite designs have been tested, it is believed that the basic concept of non-axisymmetric flow can be illustrated in FIG. 3*d*.

FIGS. 3*c* and 3*d* schematically illustrate how the momentum flux, local maximum flow rate and velocity of the gas flow field can be depicted and quantified around the gas nozzle tip. For simplicity, only the momentum flux has been illustrated.

Prior to discussing non-axisymmetric flow, FIG. 3*c*, which schematically illustrates a fully axisymmetric nozzle, will first be discussed. This fully axisymmetric nozzle will be contrasted with FIG. 3*d* which illustrates a non-axisymmetric square melt guide tube nozzle. The number 500 represents a bottom view of a circular melt guide tube and 502 represents a bottom view of a square melt guide tube. As illustrated, numbers 1 and 2 indicate two different views of the gas flow and melt guide tube tip approximately 90° apart along the external portion of the melt guide tube surfaces. As can be seen, the arrows 503 and 505 represent gas flow exiting a plenum 506.

For the axisymmetric design, each of the side views 504 and 508 are identical. The side views for the non-axisymmetric square melt guide tube are different because of the surface contours shown in FIG. 3*b* and as number 509 in FIG. 3*d*. The tip view changes with circumferential position.

When the pressure in the gas plenum 506 is equal, than the magnitudes of the momentum flux $|\bar{P}|$ are equal for both the axisymmetric and the non-axisymmetric melt guide tubes.

$$|\bar{P}_s|=|\bar{P}_n|$$

In a two dimensional analysis, however, the momentum flux vector consists of an axial ($P_a$) and a radial ($P_r$) component where:

$$\bar{P}=\bar{P}_a=\bar{P}_r$$

In an axisymmetric melt guide tube, the components are independent of circumferential position. The magnitude and direction of the two components are always the same and, as a result:

$$\frac{P_{a_1}}{P_{a_2}}=1 \text{ and } \frac{P_{r_1}}{P_{r_2}}=1$$

By using one version of a non-axisymmetric design, such as the square design shown in FIGS. 3*b* and 3*d*, however, the angle of the momentum flux vector can be varied with respect to circumferential position. In fact, if the nozzle tip is designed so the gas flow remains attached to the nozzle surface, the angle of the momentum flux is substantially the angle of the surface. Thus, the magnitude of the axial and radial components continuously change with circumferential position and generally:

$$\frac{P_{a_1}}{P_{a_2}}\neq 1 \text{ and } \frac{P_{r_1}}{P_{r_2}}\neq 1$$

This effect on the momentum flux is schematically shown in the graphs 520 and 522 where the components are normalized and schematically plotted as a function of circumferential position. In the case of the axisymmetric melt guide tube, the two components are constant, for the non-axisymmetric square melt guide tube, the components magnitude and direction change as a function of position. The graphs 520 and 522 clearly illustrate the two important properties of non-axisymmetric flow, that being the peak to peak changes in magnitude of the momentum flux components and the spatial repetition distances or wave lengths of these components around the circumference of the melt guide tube.

Table 1 illustrates the range of the momentum flux, the local gas mass flow rate, and their wave lengths calculated at the gas orifice and melt guide tube tip that has been tested and found to be effective. The magnitude of the components are normalized. Peak to peak circumferential variation is shown as the ratios of the momentum flux components local mass flow rates.

The practical limits of the spatial frequency of the peak to peak variations is presently unproven. However, it is believed that wave lengths much below those actually tested will have a diminishing effect. Greater wave lengths will require increased melt nozzle sizes and may be impractical due to increased melt flow rates. Presently, it is believed that any close-coupled atomization system for atomizing liquid metals that produces a non-axisymmetric gas flow field where any one of a number of properties, as measured and/or calculated at the plane of the melt orifice, exceeds certain ratios of peak value to minimum values when measured or calculated for different circumferential positions around the melt guide tube tip will produce improved yields of fine particles as compared to a fully axisymmetric atomization system. Specifically, the values of the properties to be measured and/or calculated include: a gas mass flux ratio greater than about 1.05; a gas momentum flux ratio greater than about 1.10; a momentum flux radial component ratio greater than about 1.10; a momentum flux axial component ratio greater than about 1.05; a gas local mass flow rate greater than about 2.0; and when the wavelength or spatial repetition distance of these values is in excess of about 0.2 inches (see Table 1).

TABLE 1

| | | | Gas Momentum Flux | | | | | | Gas Mass Flow Rate | | | Gas Flow | Gas Flow | | | | |
|---|---|---|---|---|---|---|---|---|---|---|---|---|---|---|---|---|---|
| | | | Conical Surface | | Flat Surface | | (A) RATIO | (A) RATIO | | | (A) LOC MASS | W-LENGTH (B) | W-LENGTH (B)G | Melt Flow | | | |
| RUN # | NON-AXI | NOZZLE GEOMETRY | RADIAL COMP | AXIAL COMP | RADIAL COMP | AXIAL COMP | RADIAL COMP | AXIAL COMP | LOC MASS FR CONE | LOC MASS FR FLAT | FR RATIO | NOZZLE TIP | GASS ORIFICE | MAJOR AXIS | MINOR AXIS | RATIO | P-RATIO |
| 750 | G & M | P MGT, Non-Axi GO | 0.375 | 0.927 | 0.5 | 0.866 | 1.33 | 1.07 | 0.013 | 0.025 | 2 | 0.332 | 0.604 | 0.245 | 0.125 | 1.96 | 1.09 |
| 751 | G & M | P MGT, Annular GO | 0.250 | 0.968 | 0.545 | 0.839 | 2.18 | 1.15 | 1 | 1 | 1 | 0.332 | — | 0.245 | 0.125 | 1.96 | 1.09 |
| 752 | G & M | P MGT, Non-Axi GO | 0.375 | 0.927 | 0.545 | 0.839 | 1.45 | 1.1 | 0.013 | .032 | 2 | 0.332 | 0.640 | 0.245 | 0.125 | 1.96 | 1.09 |
| 755 | G & M | SPMGT, Annular GO | 0.250 | 0.968 | 0.545 | 0.839 | 2.18 | 1.15 | 1 | 1 | 1 | 0.332 | — | 0.245 | 0.125 | 1.96 | 1.09 |
| 756 | G & M | S MGT, Annular GO | 0.250 | 0.968 | 0.438 | 0.899 | 1.75 | 1.08 | 1 | 1 | 0.2 | 0.27 | — | 0.28 | 0.25 | 1.41 | 1.13 |
| 769 | G & M | P MGT, Annular GO | 0.252 | 0.967 | 0.545 | 0.839 | 2.16 | 1.15 | 1 | 1 | 1 | 0.332 | — | 0.24 | 0.12 | 2 | 1.09 |
| 770 | G & M | P MGT, Annular GO | 0.252 | 0.967 | 0.545 | 0.839 | 2.16 | 1.15 | 1 | 1 | 1 | 0.332 | — | 0.24 | 0.12 | 2 | 1.09 |
| 772 | G & M | P MGT, Annular GO | 0.252 | 0.967 | 0.545 | 0.839 | 2.16 | 1.15 | 1 | 1 | 1 | 0.368 | — | 0.24 | 0.12 | 2 | 1.09 |
| 773 | G & M | S MGT, Annular GO | 0.250 | 0.968 | 0.438 | 0.899 | 1.75 | 1.08 | 1 | 1 | 1 | 0.27 | — | 0.28 | 0.25 | 1.41 | 1.13 |
| 794 | G & M | S MGT, Annular GO | 0.250 | 0.968 | 0.485 | 0.875 | 1.94 | 1.11 | 1 | 1 | 1 | 0.27 | — | 0.28 | 0.25 | 1.41 | 1.13 |
| 795 | G & M | S MGT, Annular GO | 0.250 | 0.968 | 0.407 | 0.914 | 1.63 | 1.06 | 1 | 1 | 1 | 0.27 | — | 0.28 | 0.25 | 1.41 | 1.13 |
| 796 | G & M | S MGT, Annular GO | 0.250 | 0.968 | 0.391 | 0.921 | 1.56 | 1.05 | 1 | 1 | 1 | 0.27 | — | 0.28 | 0.25 | 1.41 | 1.13 |
| 801 | G & M | S MGT, Annular GO | 0.250 | 0.968 | 0.391 | 0.921 | 1.56 | 1.05 | 1 | 1 | 1 | IND | 0.73 | 0.28 | 0.25 | 1.41 | 1.13 |
| 809 | G only | Elliptical GO | 0.218 | 0.976 | 0.218 | 0.976 | 1 | 1 | 0.03 | 0.08 | 2.5 | IND | 0.73 | 0.19 | 0.19 | 1 | 1 |
| 810 | G only | Elliptical GO | 0.218 | 0.976 | 0.218 | 0.976 | 1 | 1 | 0.03 | 0.08 | 2.5 | IND | 0.73 | 0.19 | 0.19 | 1 | 1 |
| 812 | G only | Elliptical GO | 0.216 | 0.976 | 0.216 | 0.976 | 1 | 1 | 0.03 | 0.08 | 2.5 | IND | 0.73 | 0.19 | 0.19 | 1 | 1 |
| 813 | G only | Elliptical GO | 0.220 | 0.978 | 0.220 | 0.978 | 1 | 1 | 0.03 | 0.08 | 2.25 | 0.54 | | 0.19 | 0.19 | 1 | 1 |
| 825 | G only | S MGT Surface | 0.250 | 0.968 | 0.515 | 0.857 | 2.06 | 1.13 | 1 | 1 | 1 | — | — | 0.19 | 0.19 | 1 | 1 |
| 826 | M only | S Melt Orifice | 0.250 | 0.968 | 0.250 | 0.968 | 1 | 1 | 1 | 1 | 1 | — | — | 0.28 | 0.25 | 1.41 | 1.13 |
| 827 | M only | S Melt Orifice | 0.250 | 0.968 | 0.250 | 0.968 | 1 | 1 | 1 | 1 | 1 | — | — | 0.28 | 0.25 | 1.41 | 1.13 |
| 828 | M only | S Melt Orifice | 0.250 | 0.968 | 0.250 | 0.968 | 1 | 1 | 1 | 1 | 1 | — | — | 0.28 | 0.25 | 1.41 | 1.13 |
| 833 | M only | 8 pt. M Orifice | 0.250 | 0.968 | 0.250 | 0.968 | 1 | 1 | 1 | 1 | 1 | — | — | 0.353 | o.261 | 1.35 | 1.48 |
| 834 | G & M | P MGT, Annular GO | 0.250 | 0.968 | 0.454 | 0.891 | 1.82 | 1.09 | 1 | 1 | 1 | 0.332 | — | 0.25 | 0.13 | 2 | 1.09 |
| 836 | G only | Tang, Gas Flow | 0.374 | 0.927 | — | — | — | — | IND | IND | INF | IND | 0.73 | 0.19 | 0.19 | 1 | 1 |
| 837 | G & M | P MGT Focused GO | 0.250 | 0.968 | 0.454 | 0.891 | 1.82 | 1.09 | 0.03 | 0.12 | 4 | 0.332 | 0.9 | 0.25 | 0.13 | 2 | 1.09 |
| 838 | G only | Focused GO | 0.250 | 0.968 | 0.250 | 0.968 | | | 0.03 | 0.12 | 4 | IND | 0.9 | 0.19 | 0.19 | 1 | 1 |
| 835 | None | Symmetrical MGT | 0.250 | 0.968 | 0.250 | 0.968 | 1 | 1 | 1 | 1 | 1 | — | — | 0.19 | 0.19 | 1 | 1 |

TABLE 1-continued

| | | | Gas Momentum Flux | | | | | | Gas Mass Flow Rate | | | Gas Flow | Gas Flow | | | | |
|---|---|---|---|---|---|---|---|---|---|---|---|---|---|---|---|---|---|
| | | | Conical Surface | | Flat Surface | | (A) RATIO | (A) RATIO | | | (A) LOC MASS | W-LENGTH (B) | W-LENGTH (B)G | Melt Flow | | | |
| RUN # | NON-AXI | NOZZLE GEOMETRY | RADIAL COMP | AXIAL COMP | RADIAL COMP | AXIAL COMP | RADIAL COMP | AXIAL COMP | LOC MASS FR CONE | LOC MASS FR FLAT | FR RATIO | NOZZLE TIP | GASS ORIFICE | MAJOR AXIS | MINOR AXIS | RATIO | P-RATIO |

GO = Gas Orifice
MGT = Melt Guide Tube
NON-AXI = Non-Axisymmetric
G & M = Gas and Melt
G only = Gas only
M only = Melt only
P MGT, = Planar Melt Guide Tube
GO = Gas Orifice
S MGT = Square Melt Guide Tube
S Melt = Square Melt
8 pt. m orifice - Eight point (star) Melt Orifice
Tang. = Tangential
Comp = C omponent
LOC MASS FR = Local Mass Flow Rate
FR = Flow Rate
W-Length = Wave Length
P-Ratio = Perimeter Ratio One means of defining the minimum effective spatial frequency or wave length of the non-axisymmetric nozzle used is to employ the periphery of either the melt guide tube tip or the gas orifice. For an elliptical gas orifice with a circular melt guide tube, the wave length would be C/2, where C is the inner circumference of the gas orifice. For circular gas orifice with a planar or square melt guide tube, the wave lengths would be C/2 and C/4, respectfully, where C is the external circumference of the melt guide tube tip. It is believed that larger wave lengths will work, but practicality is limited by the fact that too large a melt guide tube will result in unacceptably large metal flow rates. It is presently believed that wave lengths less than C/8 will not significantly improve atomization over axisymmetric flow due to lateral spreading of the gas jets.

It should be noted that wave lengths based on the internal circumference of the melt guide tube orifice have not as yet been determined; however, such determinations may produce similar results as those calculated using the external circumference or there may be some unanticipated differences.

Figure 4:
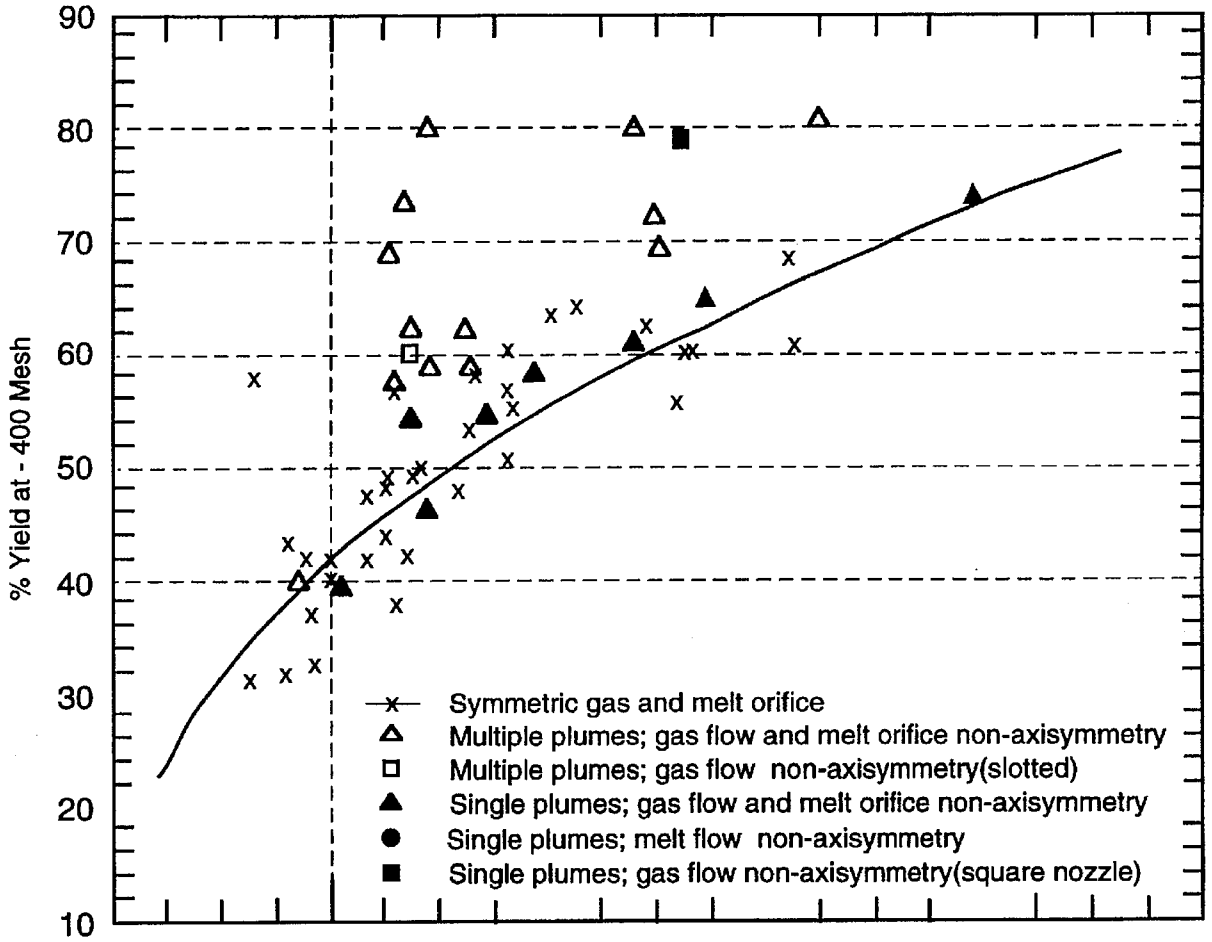
FIG. 4 is a graph which shows the −400 mesh nickel base superalloy powder from a plurality of non-axisymmetric atomization system configurations compared to a band of the best axisymmetric atomization system configurations.

FIG. 4 illustrates the −400 mesh yield of nickel base superalloy powder from many non-axisymmetric configurations or geometries compared to a band of the best axisymmetric configurations or geometries comprising hundreds of tests. As can be seen, the resulting yield of fine powders is definitively improved for non-axisymmetric system configurations or geometries as compared to the best axisymmetric system configurations or geometries.

As shown, all experimental runs in which the close-coupled system utilized non-axisymmetric gas and melt flow show increased yields of fine powder, especially in the two (2) to six (6) gas to melt flow rate ratio range. As is known, the lower the gas to melt flow rate ratio, the less gas is used in atomization. Thus, the lower the gas to melt flow rate ratio, the less expensive the fine powder produced thereby will be. Thus, the real economic value of asymmetry (non-axisymmetric) becomes apparent. At very high gas to metal ratios, the yields of axisymmetric and non-axisymmetric close-coupled nozzles approach each other. But at low gas to metal ratios, about 2–4, the yield of the non-axisymmetric nozzle designs can be up to about forty (40%) greater, or approximately double the yield of the symmetric close-coupled nozzles.

It has now been determined that the best non-axisymmetric fine yield performance occurs when both non-axisymmetric orifice gas flow and non-axisymmetric melt guide tube tip exit orifice melt flow are utilized in combination, and which are operated using atomization parameters that produce a non-axisymmetric (i.e. non-conical) atomization plume or multiple plumes.

The uniqueness, as it ultimately was determined, of the initial non-axisymmetric concept was that the melt guide tube orifice and the gas orifice were individually non-axisymmetric. As illustrated in FIG. 5*c*, the result is a very broad, well dispersed, non-axisymmetric atomization plume 116 compared to the axisymmetric atomization plume of FIG. 5*a*. Droplet number density variation occurs as both a function of radial and circumferential position in the plume causing an overall non-axisymmetric appearance close to the nozzle tip (5*d*). This density variation can be sufficiently large so that the plume is actually subdivided, or at least appears to be subdivided, into two or more individual plumes 118 (5*e*, 5*f*).

One definition for a non-axisymmetric atomization plume is when measurement of the periphery of a cross section of the plume exceeds 109% of circumference of plume of equivalent cross sectional area. The measurement of the periphery of a cross section of the plume is only applied close to the nozzle tip where non-axisymmetry can be detected by eye, such as for example, about one (1) to about five (5) melt guide tube tip diameters from the melt guide tube exit orifice.

There are other issues which may be critical in the performance of the non-axisymmetric atomization system, such as internal film flow and external recirculation of the melt. Currently, however, the most notable characteristic of the non-axisymmetric systems is the presence of a non-axisymmetric plume or in the extreme, multiple plumes during atomization. The existence of a non-axisymmetric plume or of multiple plumes is easily detected with standard or high speed photographic techniques.

Figure 6A:
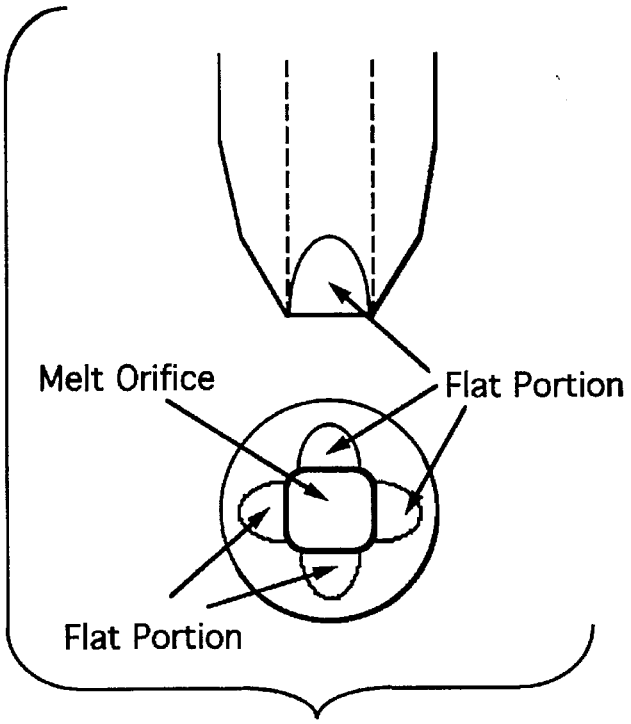
FIG. 6*a* is a schematic of a square non-axisymmetric melt guide tube exit orifice and a non-axisymmetric contoured exterior.

Images of atomization plumes are shown in FIGS. 6*a–d* for circular, planar and square type melt guide tube tip cross sections. The images in FIGS. 6*a–d* are video frames from the output of a near infrared radiometer which produces the graphical output on the left of the images. The melt guide tube tips are shown facing upward in these images and the circular mask around the outside of the images is from the gas purged aperture cone in the atomizing chamber. Image 6*a* is a typical axisymmetric atomization condition. Images 6*b* and 6*c* are planar nozzle images taken perpendicular to the long axis of the nozzle and at 45° from the long axis respectively. Note that the strongly split sub-plumes in image 6*b* appears to further split when viewed as in FIG. 6*c*, producing what appears to be four distinct sub-plumes. FIG. 6*d* is an image of a square melt guide tube nozzle taken in line with the diagonal, three of the four sub-plumes are visible. As shown, these sub-plumes may occur as visually discrete multiple plumes close to the melt guide tube tip 120 or melt exit point and produce powder having very high yield fines. Further downstream, from the melt exit point, however, the multiple sub-plumes begin to overlap and the multiple sub-plume structure dissipates.

The rate and magnitude of the gas jet expansion in the direction normal to the gas jet appears to limit the degree on non-axisymmetry that can be obtained; for instance, far downstream from the gas orifice, the atomization plume retains almost no information about the details of the gas orifice geometry. Thus the circumferential spatial periodicity of the non-axisymmetry must be large to retain maximum non-axisymmetric gas flow effects. Because of this, work was confined to configurations with two axis of symmetry. It is believed that higher orders of symmetry will not be as beneficial (i.e. hexagonal, octagonal etc. nozzles) without substantial increases in the nozzle area and perimeter.

It is presently believed that the major differences in fine powder yield between axisymmetric and non-axisymmetric atomization systems are attributable to differences in the atomization fluid, either liquid or gas or a combination of both, liquid metal interaction. However, simple analytical tools and phenomenological descriptions developed for axisymmetric cases appeared to continue to apply to the non-axisymmetric atomization systems.

It is also presently believed that non-axisymmetry melt guide tube tip external surface configurations and/or gas nozzle configurations increases the yield of fine powder because of a combination of three melt liquid-fluid interaction effects: non-axisymmetric fluid, such as gas or liquid, for example, water, flow results in apparently stabilized gaps in the liquid melt film formed near the tip of the melt guide tube exit orifice resulting in a steadier melt delivery without the irregularity of flow observed in high speed video studies of axisymmetric nozzles; these stabilized gaps in the liquid melt film are believed to produce stronger fluid jets, such as gas jets, inside the melt guide tube proximate the exit orifice which is believed to produce thinner melt films and even more stable melt delivery rate and some non-axisymmetric flows have been observed to result in a more rapid radial spread of the melt droplets, exposing liquid to higher velocity gas with finer droplet formation and reducing the probability of coalescence.

The primary atomization improvement mechanism for the non-axisymmetric gas nozzle orifice geometries is believed to be forcing the melt flow outwardly away from the melt guide tube exit orifice and its axis into higher velocity gas flow. Plume broadening directly implies the existence of this mechanism and is believed to lead to both smaller droplet formation and less droplet recoalescence.

The non-axisymmetric melt guide tube geometries tested have had one or two symmetry planes, and the gas orifice annular gap has been relatively large compared to the orifice to nozzle tip length dimension (20% to 100%). Thus, circumferential differences in the jet are not easily lost to jet expansion and merging. Nonetheless, it is presently believed that only moderate to large non-axisymmetry effects make a measurable difference in fine powder yield. Thus, it is presently believed that higher orders of symmetry, such as occurs with multiple discreet jet nozzles, would create rather weak perturbations and would not have the desired effect of stabilizing the film breaks or forcing plume spreading. It is believed that the prior existence of multiple symmetry planes in these types of atomization processes had not been previously discovered.

Plume splitting, as illustrated in FIG. 5, has been determined to be an operational marker for higher fine powder yields with non-axisymmetric melt guide tube external surface gas flow and/or gas nozzle geometries. This gain in yield with the occurrence of multiple plumes is clearly shown in FIG. 4.

Based on tests reported in Ser. No. 08/415,834, it was concluded that both internal and external non-axisymmetric geometries contributed to plume splitting and fine powder yield improvement. Also, concerning the internal non-axisymmetric geometries, no plume splitting was observed during atomization although, close to the meet orifice, the cross section of the plume was non-axisymmetric and clearly lobed as shown in FIG. 5*c*. Thus, the non-axisymmetry effects introduced inside the plenum did not appear strong enough, on its own, to produce plume splitting during atomization and, as a result, fine powder yields were lower than when plume splitting was observed.

FIG. 3*b* depicts a fully non-axisymmetric close-coupled nozzle that utilizes both non-axisymmetric melt flow and non-axisymmetric gas flow.

Figure 6B:
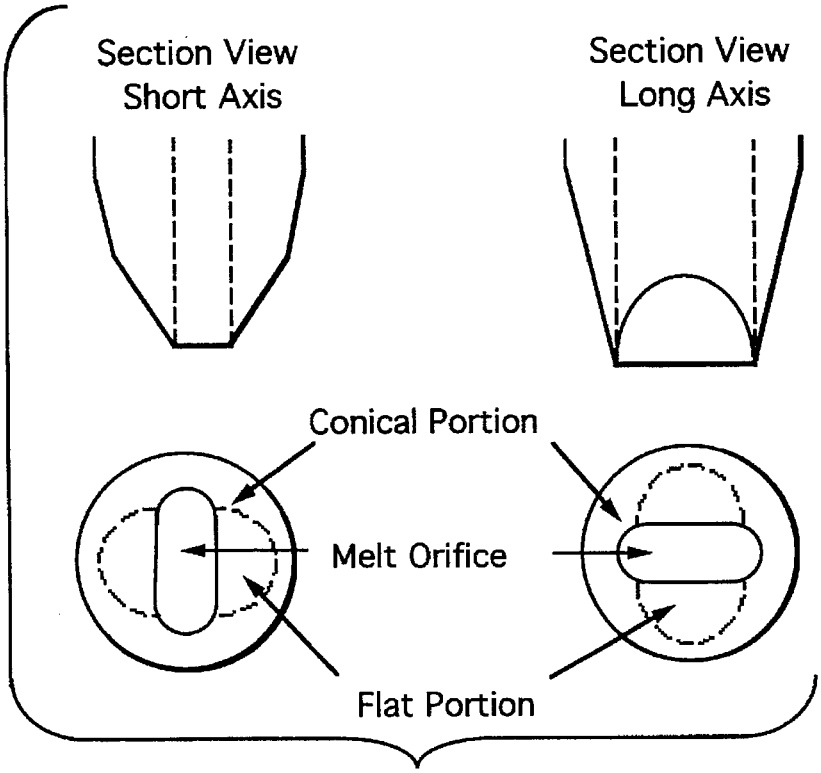
FIG. 6*b* is a schematic of a planar non-axisymmetric melt guide tube exit orifice and non-axisymmetric contoured exterior.

FIG. 6*a* illustrates the general tip configuration of the square meet guide tube shown in the non-axisymmetric close-coupled system of FIG. 3*b*. The exterior surface of the melt guide tube has flats cut into it to create non-axisymmetric gas flow. Also, since the melt exit orifice is square, the melt delivered to the atomization zone flows in a non-axisymmetric square configuration. Thus, the meet guide tube of FIG. 6*a* produces both non-axisymmetric melt flow and non-axisymmetric gas flow. Additionally, FIG. 6*b* shows, as a further example, a planar melt guide tube geometry that also produces both non-axisymmetric melt flow and non-axisymmetric gas flows.

Figure 7A:
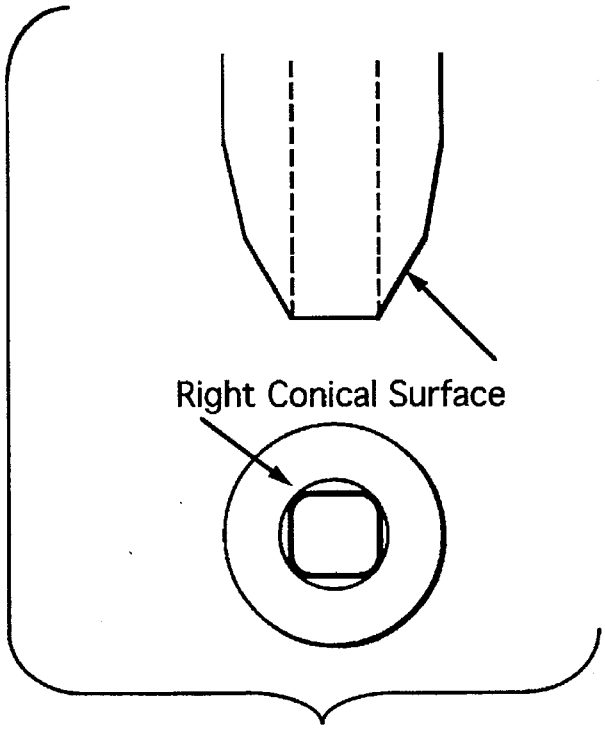
FIG. 7*a* is a schematic of a square non-axisymmetric melt guide tube exit orifice with axisymmetric exterior.
Figure 7B:
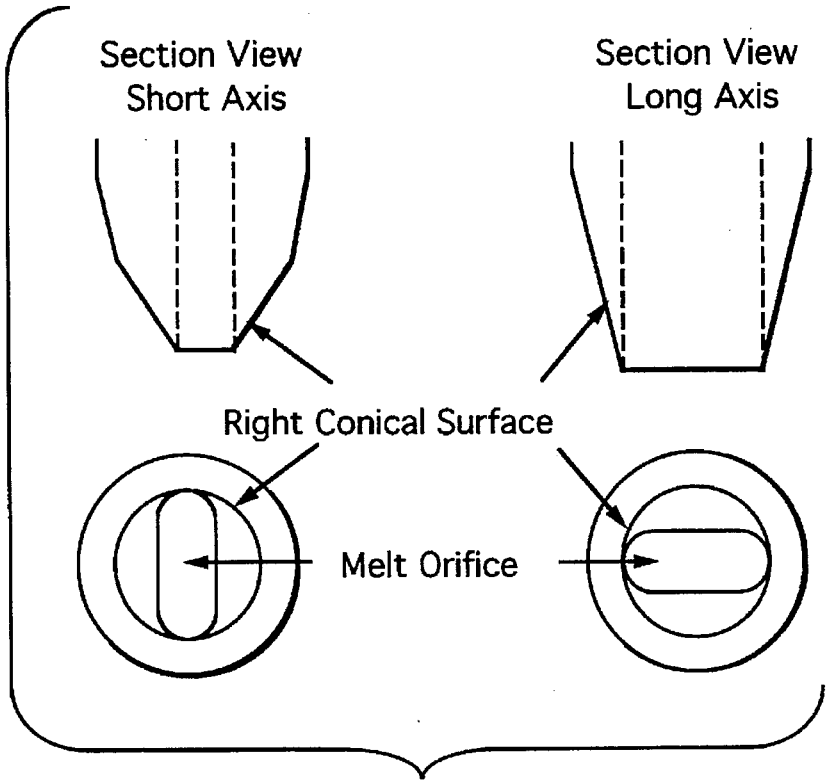
FIG. 7*b* is a schematic of a planar non-axisymmetric melt guide tube with an axisymmetric exterior.
Figure 7C:
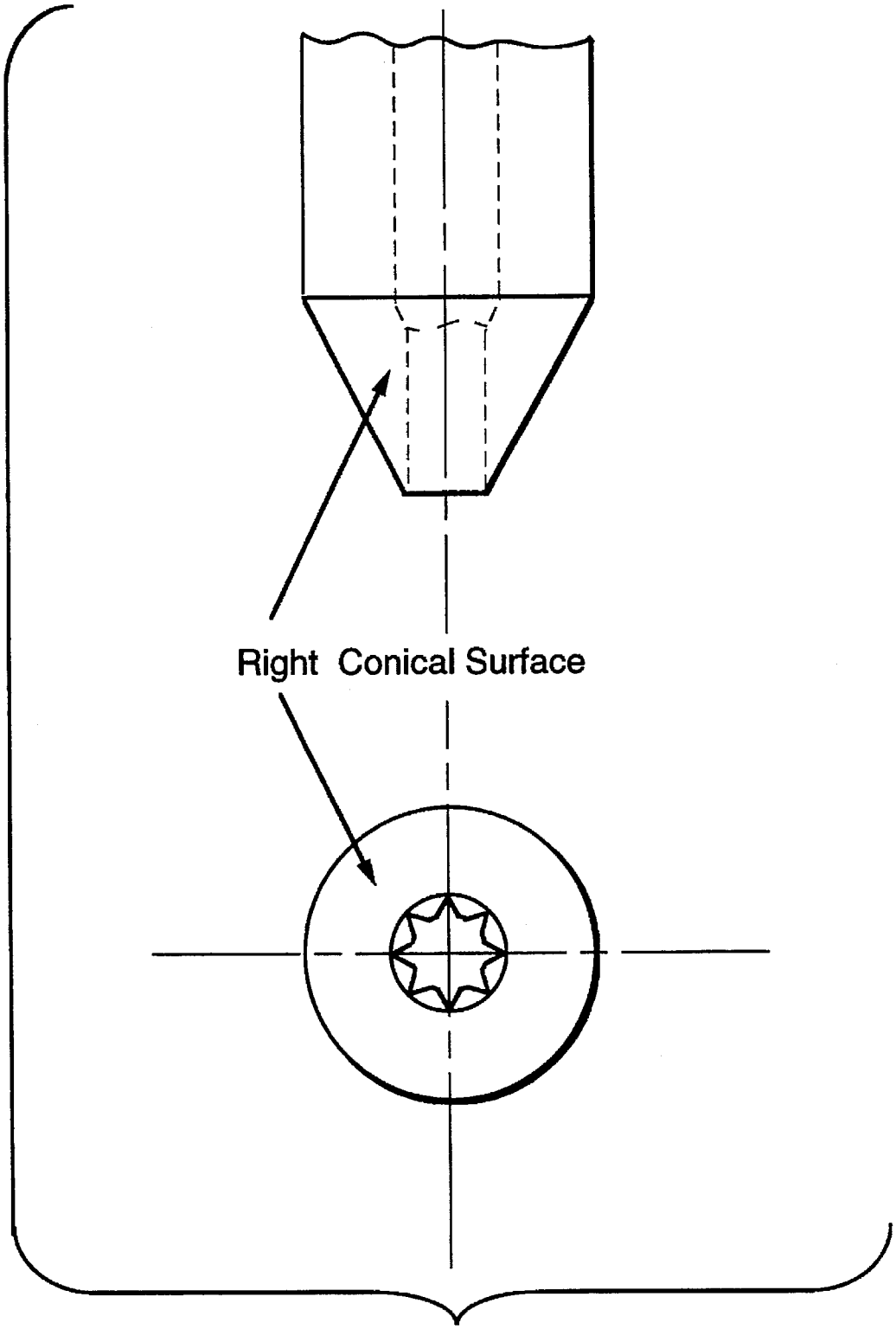
FIG. 7*c* is a schematic of a star-shaped non-axisymmetric melt guide tube with an axisymmetric exterior.

FIG. 7*a–c* are examples of melt guide tube configurations that provide non-axisymmetric melt flow and axisymmetric gas flow. The external surface of the tube tip is a simple right frustum which provides a completely axisymmetric gas flow to the atomization zone, while only the melt exit orifice is non-axisymmetric. Three versions are shown, one in which the melt orifice is a square (FIG. 8*a*). one in which the melt orifice is a thin strip (planar, FIG. 7*b*); and one where the melt orifice is an eight pointed star (FIG. 7*c*).

The results of atomizing nickel base superalloys using these non-axisymmetric melt orifice configurations as well as many other non-axisymmetric gas flow and melt flow configuration or geometries are shown in FIG. 4.

From viewing FIG. 4, it should be clear that the use of both non-axisymmetric gas flow and non-axisymmetric melt flow, as a whole, produces far more efficient atomization and higher yields of fine powder than axisymmetric gas flow and axisymmetric melt flow, especially at low gas to metal ratios. The use of non-axisymmetrical melt flow alone, i.e. no non-axisymmetry in the gas flow, is not as efficient as with both non-axisymmetric gas flow and non-axisymmetric melt flow, but still produces a higher yield of fine powder than does axisymmetric melt flow and axisymmetric gas flow.

That non-axisymmetric melt flow improved the yield of fine power and, thus, the atomization process was a surprise, as it was previously believed that the momentum of the gas flow field completely dominated the atomization process. It is possible that the non-axisymmetric melt exit orifice aids the reentrant gas jet in allowing the melt to be distributed preferentially to the external corners of the melt orifice. While this might be expected to produce a non-symmetrical plume and/or metal web right in the vicinity of the melt orifice, this was not observed experimentally. Thus, the mechanism that produces the improved yield of fine powder is still a matter of conjecture, although the data of FIG. 6 shows non-axisymmetry in the melt flow alone clearly improves atomization.

Quantifying the impact of the non-axisymmetric effect in the melt flow has proven quite difficult and it is believed not sufficiently described by the use of planes of symmetry. Hence, the ratio of the periphery to the circumference of a circle of equal area and by the ratio of the major and minor axis of the orifice shape has been chosen as the means of description. Table 1 shows these values for an axisymmetrical melt orifice and the non-axisymmetric melt orifices tested. Yield improvement were observed when the periphery dimension was about 10% to about 50% larger than the equivalent area circle and the ratio of the major and minor axis was in the range of about 1.3 to about 1.4.

It should be noted that no attempt has been made to identify the minimum values of the non-axisymmetric parameters that would be operative. Table 1 only shows the value that were tested. It is believed that other parameter values would work and would produce higher yields of the powder than axisymmetric gas orifices and axisymmetric melt exit orifices produce.

High speed photographs of axisymmetric atomization processes, taken using different electronic shutter speeds, show that the atomization plumes have a conventional appearance in that the atomization plume has a very diffuse structure with many droplets randomly spread over space when photographed at 1/30 second, visible as a very diffuse structure consisting of many small droplets. As the framing speed is increased, i.e. decrease the shutter time, going from 1/30 of a second, to 1/10,000 of a second to 1/50,000 of a second, two phenomena occur: 1) the high velocity liquid metal becomes frozen in space so it can be imaged and 2) because of the increased shutter speed, the small droplets on the periphery of the plume do not emit enough light to actually be detected by the camera and one begins to see through the periphery of the atomization plume to the core or center of the atomization plume where the larger metal ligaments are located.

As the shutter speed is increased and the exposure time is decreased, the droplets from the outside of the atomization plume are not imaged but the metal ligaments that are in the core of the atomization plume are imaged because they are so much more luminous. In fact, at very high speeds of 1/100,000 and 1/1,000,000 of a second, there is a long quasi-continuous core of liquid metal that extends out from the tip of the nozzle and down axis from the nozzle. The gas flow has compressed this liquid stream along the axis of the nozzle. In this case, there are large metal ligaments which are poorly broken up and in close proximity to each other. Thus, coalescence due to contact between the droplets and liquid ligaments is high in this core region of the atomization plume, reducing the number of small droplets that solidify to form fine powder.

Thus, in this system, it is clear that the metal stream has not been broken up as effectively as might be indicated by the very low speed (1/30 sec) images. With the axisymmetric nozzle we have a single source of liquid metal coming out the tip of the nozzle and droplets being stripped off.

With the square nozzle, on the other hand, the forces caused by the gas flow, the metal comes out from the nozzle as essentially four separate streams emanating from the corners of the nozzle and then as those sub-plumes move within the atomization plume downstream, they move away from each other and away from the plume center toward the periphery of the plume. In the high speed pictures, the plume appears to result from four nozzles pointed slightly away from one another. Cores of liquid metal appear where the metal is coming off the nozzle tip, but now they have moved out from the plume center and away from one another so the high density of liquid metal is no longer on the axis of the nozzle but has moved out towards the periphery of what can be considered the total atomization plume.

Using a planar nozzle, the metal appears to be in a single stream. The stream exiting the melt guide tube is apparent only for a short distance down stream from the tube exit orifice before it is broken up so that at least separate cores or three fingers of metal are visible. Since one of the fingers happens to be behind one of the other, there are probably four cores or fingers due to the camera angle. Thus, a planar nozzle is different from an axisymmetric one in that rather than compressing the metal into a narrow region down the axis of the nozzle, the atomizing gas is actually distributing the liquid metal out to the periphery of the plume away from the center of the plume. Thus, most of the liquid metal is concentrated out at the edges of the plume in four separate sub or mini-plumes each having a metal core. With the metal being distributed over a wider region and in a greater volume, the probability of droplet to droplet contacts is significantly reduced from that of the single metal core produced by an axisymmetric nozzles. Thus, with the method of the present invention the droplet to droplet contact is significantly reduced, coalescence is significantly reduced and a finer powder results.

With the method of the present invention, instead of compressing the metal stream and striping away the metal from a single core of melt, the stream is split into sub-streams and moved out from the center toward the periphery of the atomization plume.

In other words, the core of liquid metal in center of an axisymmetric plume is physically moved so that there are multiple metal cores located near the periphery of the atomization plume. These multiple metal cores are smaller, because the four, for example, as shown, have the same metal flow as the large metal core but are positioned relatively away from each other so all the droplets that are breaking off are being accelerated away in a much larger volume of space or the overall atomization plume. With the methods of the present invention, with an elongated slot, the surface area of the metal and the volume of space has been at least doubled if not quadrupled.

Since the metal core's ligaments have greater separation, the chance for droplet to droplet collision is much less as opposed to the axisymmetric situation where the droplets are stripped off only one central metal core.

It should be clear that, with the method of the present invention, instead of compressing the stream of metal into a single relatively central core, which results in a single very tight atomization plume with a high concentration of metal droplets, the atomization plume is expanded outwards from the center so that same amount of liquid metal is atomized into a larger volume of space, as compared to connector axis sub-plumes. Even when the overall atomization plume is the same size, by positioning multiple metal cores toward the outside of the atomization plume rather than leaving a single liquid metal core in the center of the atomization plume, the melt flux of each core is reduced resulting in greater inter droplet distances and fewer droplet collisions. The same number of metal droplets are being produced in either process, however with the previous methods, all the droplets were emanating from a single metal core in a much smaller volume than they are with the methods of the present invention. With the methods of the present invention, the dispersion of the metal droplets in the plume has been increased thereby reducing the recoalescence and therefore improving the yield of fine powder.

As discussed above, axisymmetric nozzle atomization plumes exhibit a waist below the nozzle tip whereas the individual plume streams in the planar and square nozzles have little or no plume waist and the overall plume structure is broader close to the nozzle (FIG. 6), indicating that the liquid melt is, in fact, forced radially outward virtually from the melt guide tube nozzle tip.

In summary, the following mechanisms are believed to be operative in non-axisymmetric atomization methods of the present invention. 1) The strong non-axisymmetry of gas flow produced by the non-axisymmetric melt guide tube tip cross section leads to a decisive and stable break in the melt film at the melt guide tube nozzle tip, allowing internal gas flows to be sustained during atomization. 2) Non-axisymmetric gas flow leads to stronger internal gas jets than occur with axisymmetric melt guide tube geometries or even with non-axisymmetric gas flow geometries. This allows film formation to occur closer to, or in, the melt guide tube tip where the film can be thinner and more stable (temporally). 3). The melt guide tube orifice non-axisymmetry favors liquid flow at the corners of the tube tip in the presence of a reentrant gas jet. The non-axisymmetry of the melt orifice reinforces the symmetry break caused directly by gas flow and strong internal non-axisymmetric gas flows force the liquid film outward into the highest velocity external gas flows for maximum shear and dispersion, as in the case of non-axisymmetric gas flow geometries.

As is also known, a partially constrained gas jet will attempt to remain attached to a nearby surface, thus, the gas jet naturally follows the surface of the melt guide tube. Therefore, continuously changing the surface angle of the melt guide tube causes the momentum vector of the gas flow to continuously change. The magnitude of the total momentum remains the same, but the magnitudes of the axial, radial and circumferential components change (see FIG. 3*d*). Essentially, one vector component is trying to interject or interrupt the metal flow and another vector component is trying to pull the melt stream away from the melt guide tube nozzle. In non-axisymmetric gas flow, the magnitude of the component piercing the metal stream and the component trying to propel the metal stream down away from the melt guide tube exit orifice are constantly changing in any plane beneath the exit orifice. This circumferential variation in the momentum vector is a possible explanation for the resulting multiple plumes.

The metal film at the nozzle tip during non-axisymmetric atomization appears as if the gas has punched stable holes in it, and as a result, rather than producing a randomly changing discontinuous film, pictures show what appears to be relatively stable films coming out of the corners of the melt guide tube and then these two (elongated slot) or four (square orifice) films break up into spray.

Figure 5A:
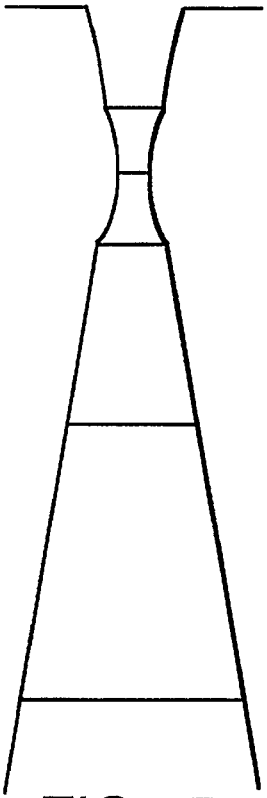
FIG. 5*a* is a schematic representation of the effect of atomizing gas on a melt exiting a nozzle in an axisymmetric atomization system.
Figure 5B:
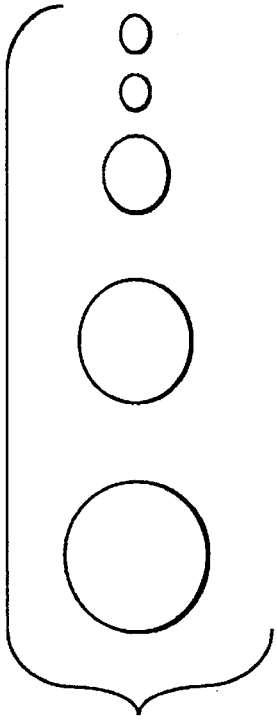
FIG. 5*b* is a graphical representation of a cross section of the atomization zone from the melt guide tube exit orifice to a position downstream of an axisymmetric atomization system.
Figure 5C:
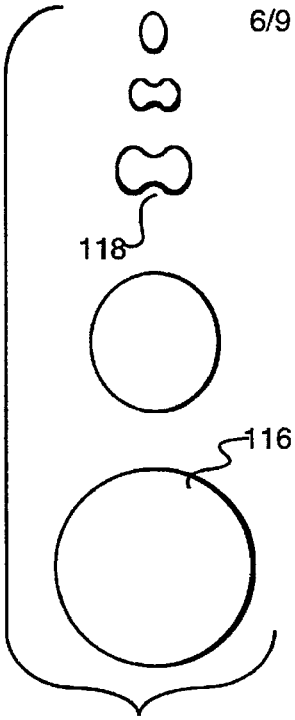
FIG. 5*c* is a schematic representation of a cross section of the atomization zone from the melt guide tube exit orifice to a position downstream from a circular melt guide tube for a gas plenum having a constrictor.
Figure 5D:
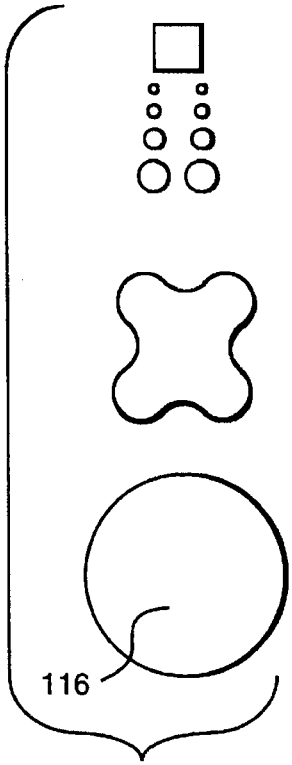
FIG. 5*d* is a schematic representation of a total non-axisymmetric atomization system having non-axisymmetric gas flow and non-axisymmetric melt flow from a square shaped melt exit orifice.
Figure 5E:
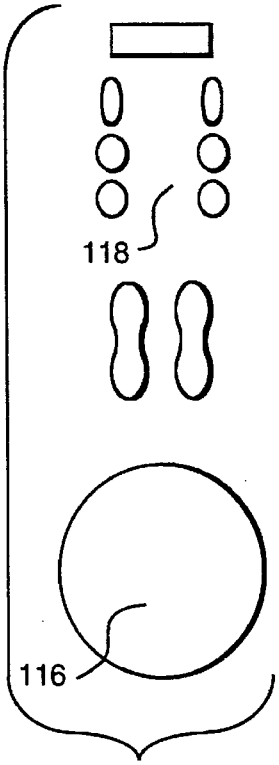
FIG. 5*e* is a schematic representation of the atomization zone of a fully non-axisymmetric atomization system having non-axisymmetric gas flow and non-axisymmetric melt flow from a rectangular or elongated slit shaped melt exit orifice.
Figure 5F:
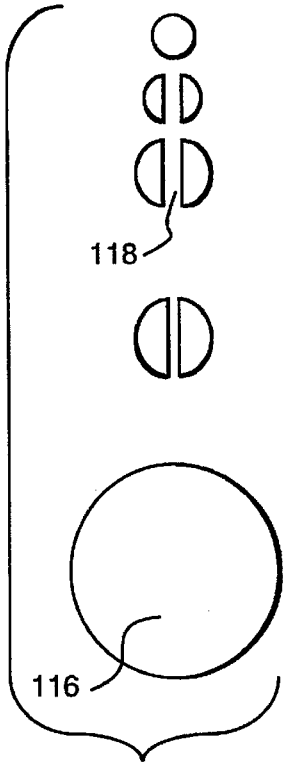
FIG. 5*f* is a schematic representation of a cross section of the atomization zone to a position downstream from a circular melt guide tube exit orifice of a non-axisymmetric elliptical fluid nozzle.

As illustrated in FIG. 5*a*, in an axisymmetric system, there is an obvious waist formed in that the metal flow is pinched or necked down, because, it is known that, the convergent gas flow constricts the metal flow before the metal expands during the atomization process to form the atomization zone. The size of the metal stream at the smallest cross section is typically three-quarters the diameter of the melt guide tube exit orifice. As illustrated in FIGS. 5*c–f*, when using a non-axisymmetric system, the metal flow exiting the melt guide tube orifice does not appear to be constricted by the impinging a gas. Thus, one of the arguments as to why a non-axisymmetric system produce a higher yield of fine particles, is that, if all the metal droplets are not compressed into a smaller region or space, chances of them colliding and coalescing into larger droplets has been reduced. Thus, the non-axisymmetric system which broadens the metal stream at the gas/metal interaction point provides for much better metal droplet dispersion.

The resulting multi-sub-plumes 2,3,4 or more emanate from the melt guide tube orifice and initially diverge from each other as they move downstream. As they continue to grow more diffuse, however, they soon overlap to again form a single plume.

It has been determined that at one end of the non-axisymmetric system operation is clearly a single axisymmetric plume and that the other end is clearly at least two or even more distinct sub-plumes within the atomization plume. The number of sub-plumes depends partially upon the number of positions or corners in the non-axisymmetric melt guide tube, such as, for example, hexagon or pentagon, as opposed to a square. It may be possible to get an additional number of plumes, but the limits are yet to be determined, as an example, when using a non-axisymmetric nozzle, depending on the operational parameter chosen, it is possible to have an axisymmetric plume, a non-axisymmetric single plume or multiple plumes. Generally, the yield of fine powder increases with the progression from axisymmetric to multiplume, with multiplume atomization providing the highest yields of fine powder. Four distinct sub-plumes have been identified utilizing a four cornered square melt guide tube orifice as well as a two cornered planar orifice.

Thus, it is clear from the above that the conventional wisdom relating to maintaining an axisymmetric gas flow in atomization systems was incorrect, in that the closer pure axisymmetric gas flow was approached, the lower the fine powder yield. It is now clear that fine powder yields can be increased by the introduction of at least some non-axisymmetric effects and preferably both non-axisymmetric gas flow and non-axisymmetric melt flow, of which non-axisymmetric gas flow appears to be the dominate factor.

While the methods disclosed herein constitute preferred methods of the invention, it is to be understood that the invention is not limited to these precise methods, and that changes may be made therein without departing from the scope of the invention which is defined in the appended claims.

What is claimed is:

1. A method for the close-coupled atomization of molten metal, the method comprising the steps of:

providing plenum means having a channel therein for delivering gas flow;

providing a melt guide tube extending through the plenum means to an exit orifice, the plenum means including means for supporting the melt guide tube;

supplying fluid flow through the channel toward said melt exit orifice and circumferentially varying momentum flux of said fluid flow;

supplying liquid metal exiting the melt guide tube such that an interaction of the fluid flow and the liquid metal form an atomization plume; and forming at least two separate detectable sub-plumes within the atomization plume at a distance of at most about 20 melt guide tube effective diameters from the melt guide tube exit orifice, wherein the effective diameter is calculated by determining the area of the exit orifice and calculating the diameter of a circle having the same area as the exit orifice.

2. A method of atomizing a molten metal melt comprising:

discharging said melt from a melt nozzle disposed at a tip of a melt guide tube;

discharging an atomizing fluid from a fluid nozzle circumferentially surrounding said tube tip, with said fluid nozzle being spaced upstream from said melt nozzle to define an external fluid attachment surface around said tube tip being unbounded by said fluid nozzle; and circumferentially varying momentum flux of said fluid along said attachment surface to initially expand and diverge said melt from said melt nozzle to form a broadened atomization plume of dispersed metal droplets wherein said atomizing fluid contacts said melt at an interaction point to produce said atomization plume having an axis, the plume containing, within at least about five (5) melt guide tube tip diameters down stream from the interaction point, at least two separate sub-plumes.

3. The method of claim 1 wherein each sub-plume is located away from the axis of the atomization plume center toward the periphery thereof.

4. The method of claim 1 wherein each sub-plume is formed around a separate core of molten metal having a density, each separate core of molten metal being positioned away from the axis of the atomization plume center toward the periphery thereof.

5. The method of claim 4 wherein the atomization plume has a reduced molten metal density along the axis of the melt guide tube.

6. The method of claim 4, wherein said varying step comprises increasing the momentum flux of the molten metal near the periphery of the atomization plume.

7. A method according to claim 2 wherein said atomizing fluid contacts said melt at an interaction point to produce said atomization plume having an axis, the plume containing, within at least about five (5) melt guide tube tip diameters down stream from the interaction point, at least three separate sub-plumes.

8. A method according to claim 2 wherein said atomizing fluid contacts said melt at an interaction point to produce said atomization plume having an axis, the plume containing, within at least about five (5) melt guide tube tip diameters down stream from the interaction point, at least four separate sub-plumes.

9. The method of claim 2 wherein the interaction of the fluid flow and the molten metal results in about seventy-one (71)% to about eight five (85)% −400 mesh powder yield of superalloy powders.

10. A method according to claim 2 further comprising channeling said fluid in a circular annulus around said tube into said fluid nozzle.

11. A method according to claim 10 wherein said momentum flux has a peak-to-minimum ratio circumferentially around said melt nozzle greater than about 1.10.

12. A method according to claim 10 wherein a radial component of said momentum flux has a peak-to-minimum ratio circumferentially around said melt nozzle greater than about 1.10.

13. A method according to claim 10 wherein an axial component of said momentum flux has a peak-to-minimum ratio circumferentially around said melt nozzle greater than about 1.05.

14. A method according to claim 10 wherein a mass flux of said fluid flow has a peak-to-minimum ratio circumferentially around said melt nozzle greater than about 1.05.

15. A method according to claim 10 wherein a local mass flow rate of said fluid flow has a peak-to-minimum ratio circumferentially around said melt nozzle greater than about 2.0.

16. A method according to claim 10 wherein said momentum flux has a circumferential spatial repetition distance greater than about 0.2 inches.

17. A method according to claim 10 further comprising transitioning said fluid flow from said circular annulus at said fluid nozzle to an annulus around said attachment surface having a plurality of circumferentially extending flats for varying said momentum flux therearound.

18. A method according to claim 17 wherein said attachment surface is conical with a pair of diametrically opposite flats therein for varying said momentum flux.

19. A method according to claim 18 wherein said melt nozzle is oblong and defined in part by terminating edges of said flats.

20. A method according to claim 17 wherein said attachment surface is conical with four circumferentially spaced apart flats therein terminating in a square at said melt nozzle.

21. A method according to claim 20 wherein said melt nozzle is square and defined in part by terminating edges of said flats.

* * * * *